US008544783B2

(12) United States Patent
Cotter et al.

(10) Patent No.: US 8,544,783 B2
(45) Date of Patent: Oct. 1, 2013

(54) FEED ASSEMBLY FOR WOOD REDUCTION APPARATUS

(75) Inventors: Chad J. Cotter, Weidman, MI (US); Nelson C. Langworthy, Vestaburg, MI (US)

(73) Assignee: Morbark, Inc., Winn, MI (US)

( * ) Notice: Subject to any disclaimer, the term of this patent is extended or adjusted under 35 U.S.C. 154(b) by 346 days.

(21) Appl. No.: 12/827,113

(22) Filed: Jun. 30, 2010

(65) Prior Publication Data

US 2011/0000988 A1 Jan. 6, 2011

Related U.S. Application Data

(60) Provisional application No. 61/222,717, filed on Jul. 2, 2009.

(51) Int. Cl.
*B02C 18/22* (2006.01)

(52) U.S. Cl.
USPC ..... 241/280; 241/186.3; 241/223

(58) Field of Classification Search
USPC ..... 241/28, 186.3, 277, 282, 280, 281, 241/223
See application file for complete search history.

(56) References Cited

U.S. PATENT DOCUMENTS

| | | | | |
|---|---|---|---|---|
| 2,954,176 | A * | 9/1960 | Knox | 241/186.3 |
| 3,661,333 | A | 5/1972 | Smith | |
| 3,861,602 | A | 1/1975 | Smith | |
| 5,657,933 | A * | 8/1997 | Williams | 241/186.3 |
| 6,189,820 | B1 * | 2/2001 | Young | 241/186.3 |
| 6,474,579 | B1 | 11/2002 | Bardos et al. | |
| 6,742,732 | B1 * | 6/2004 | Hundt et al. | 241/28 |

* cited by examiner

*Primary Examiner* — Mark Rosenbaum
(74) *Attorney, Agent, or Firm* — Warner Norcross & Judd LLP

(57) ABSTRACT

An infeed assembly for a wood reduction apparatus that is selectively adjustable to feed waste into a wood reduction mill along different paths. In one embodiment, the infeed assembly includes at least one movable wall segment that is pivotally movable between extended and retracted positions. In the retracted position, the infeed assembly feeds wood waste into the mill along a path perpendicular. In the extended position, the infeed assembly feeds wood waste into the mill along an angled path. The wall segment may include a fixed end that is pivotally secured to the sidewall and a free end that is selectively movable into the infeed path to provide a surface directing the wood waste along an angled path into the mill. The infeed assembly may include two wall segments that are pivotally extendable into the infeed path from opposite sidewall. The two wall segments may pivot from opposite ends.

17 Claims, 11 Drawing Sheets

FEED ASSEMBLY FOR WOOD REDUCTION APPARATUS

This application claims the benefit of U.S. Provisional Application 61/222,717, entitled FEED ASSEMBLY FOR WOOD REDUCTION APPARATUS, which was filed on Jul. 2, 2009.

BACKGROUND OF THE INVENTION

The present inventions relates to wood reduction equipment and more particularly to feed assemblies for a wood reduction apparatus.

Various machines are available on the market for reducing waste wood, such as scrap timber, tree limbs and brush. One common type of wood reduction machine is a wood grinder. Grinders typically operate by essentially hammering wood into wood fragments in a hammermill. For example, a conventional grinder may include a hammermill with a rotating drum. The drum carries a plurality of hammers that protrude from the surface of the drum. In use, wood waste is fed into the rotating drum. As the waste passes into the swath of the hammers, it is battered into wood fragments. The wood fragments may be driven by the hammermill through grates. The size of the holes in the grates may be selected to assist in controlling the size of the resulting wood waste.

A typical grinder includes an infeed assembly that delivers wood waste to the hammermill. For example, a conventional infeed assembly moves wood into a hammermill in a direction perpendicular to the axis of rotation of the hammermill. Because wood waste often includes brush, limbs and other waste that is most easily fed into the feed assembly in random piles or clumps, it is typically desirable to provide the grinder with a wide hammermill and a wide feed assembly that can accommodate wide piles or clumps of waste. Narrower feed system can require small piles or clumps and therefore may slow down feeding and operation of the grinder.

SUMMARY OF THE INVENTION

It has been determined that a hammermill will typically operate more efficiently when wood waste is fed into the hammermill at an angle to the longitudinal extent of the wood fibers. The wood grinding operation reduces wood waste principally through a combination of separating and shearing (e.g. cutting) wood fibers. Fiber shearing typically requires more force than fiber separation. Because wood fibers are typically extended along the length of a piece of wood, the amount of fiber shearing versus the amount of fiber separation will typically vary depending on the angle at which the wood item is fed into the hammermill. When the wood is fed perpendicularly into the hammermill, the ability of the hammers to separate the wood fibers is relatively limited and the hammers are required to shear a relatively large percentage of the wood fibers. When logs or other similar items are fed into the hammermill at an angle, the hammers typically have the ability to separate a larger percentage of the wood fibers and therefore require less wood shearing. Accordingly, less horsepower is generally required to grind logs fed into the hammermill at an angle than would be required if the logs were feed perpendicularly into the hammermill.

With limbs, brush and random clumps or piles of waste material, a conventional feed system will generally feed the waste into the hammermill so that individual items engage the hammermill in random orientations. This typically results is reasonably efficient operation for random clumps or piles. On the other hand, a conventional feed system will typically feed longer pieces of wood waste, such as logs and longer tree limbs, perpendicularly into the hammermill. This will typically require the hammermill to shear a relatively large percentage of the wood fibers and therefore require increased horsepower. Accordingly, a conventional wood reduction apparatus may not provide optimal performance with longer tree limbs and other similar items of waste that are typically fed perpendicularly into the hammermill.

The present invention provides a wood reduction apparatus with an adjustable feed system that is selectively adjustable to allow waste to be selectively directed into the mill along a perpendicular path or an angled path with respect to the mill. In one embodiment, the feed system includes a feed conveyor and a pair of sidewalls oriented perpendicularly to a hammermill. In this embodiment, the feed system includes at least one wall segment that is selectively pivotal to provide an angled wall that feeds wood waste in the mill at angle rather than perpendicularly. In one embodiment, the wall segment is selectively pivotal into the space over the feed conveyor.

In one embodiment, the wall segment includes a fixed end that is pivotally secured to the sidewall and a free end that is movable away the sidewall through operation of an actuator. In one embodiment, the actuator is a linear actuator, such as a hydraulic cylinder, coupled to a hinged arm assembly.

In one embodiment, the feed system includes a pair of wall segments that are selectively pivotal into the space over the feed conveyor from opposite sidewalls. The two wall segments may be mounted directly opposite one another on opposite sidewalls. The two wall segments may pivot from opposites ends so that they cooperatively define a feed space that extends at angle with respect to the mill.

The present invention provides a simple and effective structure that permits an infeed assembly to selectively feed wood waste into the mill in a direction perpendicular to the mill or in a direction that is angled with respect to the mill. This permits the infeed assembly to be selectively adjusted to the feed direction most suitable for the type of wood waste being fed into the wood reduction apparatus. Use of the present invention may reduce the horsepower required to reduce certain waste while maintaining relatively high flow through rates by permitting adjustment to the greatest possible infeed width.

These and other objects, advantages, and features of the invention will be more fully understood and appreciated by reference to the description of the current embodiment and the drawings.

DESCRIPTION OF THE CURRENT EMBODIMENT

I. Overview

Figure 1:
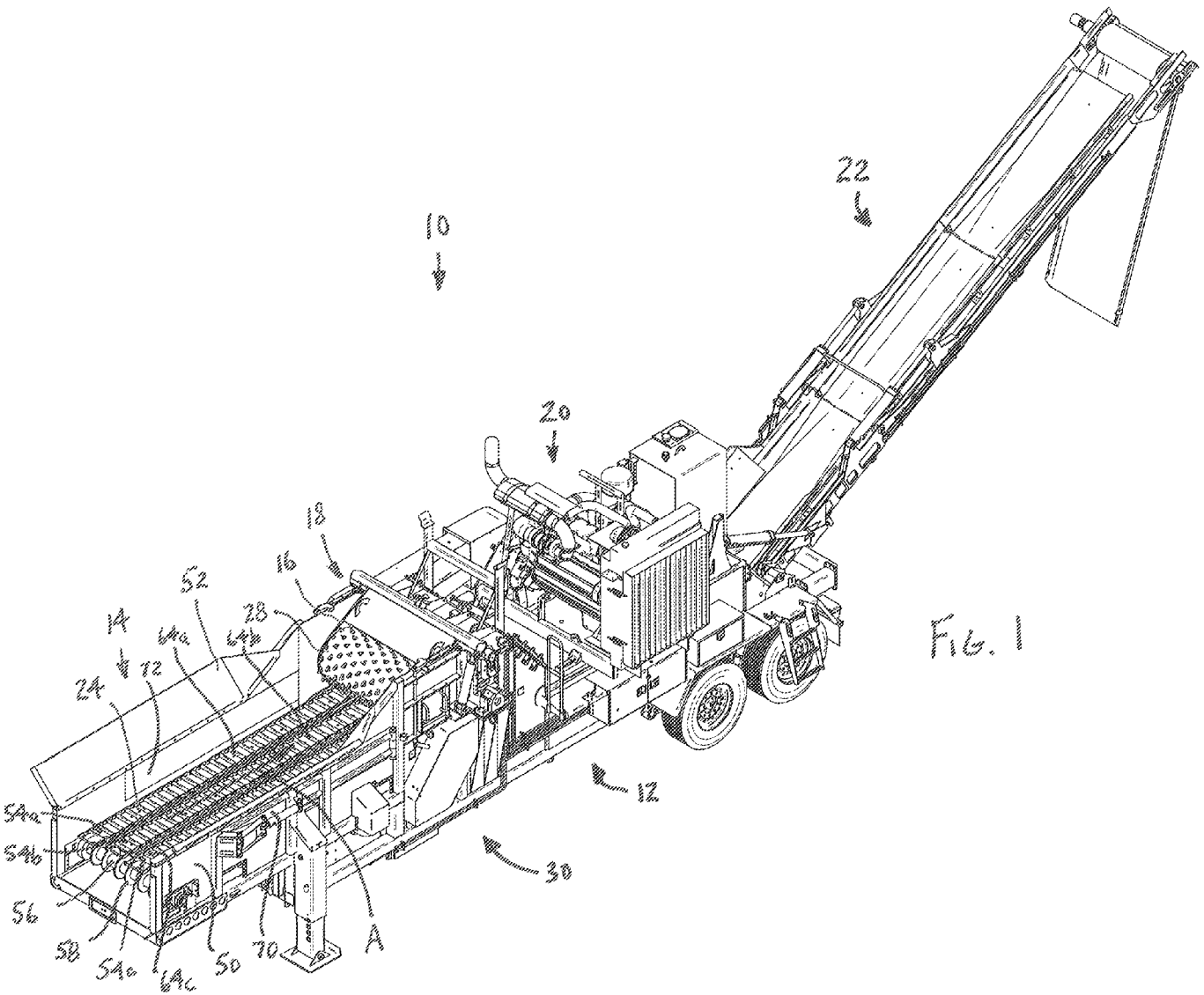
FIG. 1 is a perspective view of a wood reduction apparatus in accordance with an embodiment of the present invention.
Figure 9:
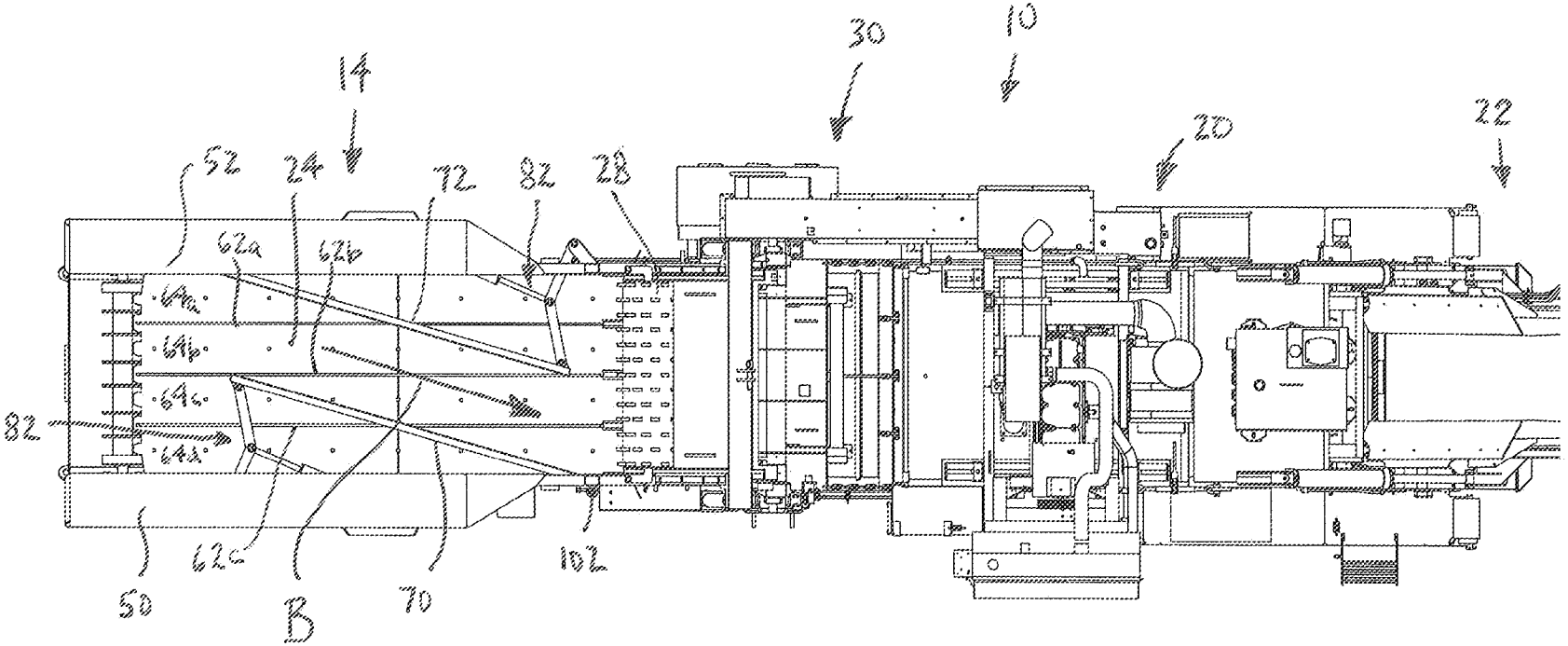
FIG. 9 is a top view of the wood reduction apparatus with the wall segments in the extended position.

A wood grinder incorporating a feed assembly in accordance with the present invention is shown in FIG. 1. The wood grinder 10 generally includes a superstructure 12, an infeed assembly 14, a hammermill 18, an engine assembly 20 and an output conveyor 22. The hammermill 18 extends laterally across the superstructure 12 and is rotatably driven by the engine assembly 20. The infeed assembly 14 extends longitudinally along the superstructure to feeding wood waste into the hammermill 18 in a direction perpendicular to the axis of the hammermill 18. The infeed assembly 14 generally includes a bed 24 fitted with a plurality of feed chains 54*a-d*. The bed 24 defines a generally horizontal surface to receive and support wood waste. The feed chains 54*a-d* are power driven to move waste placed on the bed 24 into the hammermill 18. The superstructure 12 includes sidewalls 50, 52 that extend upwardly along opposite sides of the bed 24 to hold wood waste on the bed 24. The sidewalls 50, 52 extend generally perpendicularly to axis of the hammermill 18. In this embodiment, each sidewall 50, 52 includes a movable wall segment 70, 72 that can be selectively pivoted into the space over the bed 24 to define a surface for shepherding wood waste into the hammermill 18 at an angle to axis of the hammermill 18. The wall segments 70, 72 may pivot at opposite ends so that they remain substantially parallel when pivoted. In use, the wall segments 70, 72 may be retracted to provide an infeed assembly 14 that moves wood waste into the hammermill 18 in a direction perpendicular to the axis of the hammermill 18 (See arrow A in FIG. 1). Alternatively, the wall segments 70, 72 may be extended to provide an infeed assembly 14 that moves wood waste into the hammermill 18 at an angle to the axis of the hammermill 18 (See arrow B in FIG. 9).

II. Wood Reduction Apparatus

For purposes of disclosure and not by way of limitation, the present invention is described in connection with a wood reduction apparatus that is generally identical to the Morbark Model 3800 Wood Hog, which is available from Morbark, Inc. of Winn, Mich. The Morbark Model 3800 Wood Hog Parts Manual is incorporated herein by reference in its entirety. The illustrated wood hog includes a stacked-plate rotor with removable hammer inserts. The illustrated wood hog includes a variety of optional features and components that are not necessary for implementation of the present invention. The present invention is not limited to use on or in connection with this specific wood hog or the specific rotor shown in the illustrations. To the contrary, the various features and aspects of the present invention are well suited for incorporation into a wide variety of wood reduction machines and a wide variety of rotors. For example, the present invention may be incorporated into essentially any wood reduction apparatus in which it may be desirable to selectively change the orientation at which materials are fed into the mill.

A wood reduction apparatus 10 in accordance with an embodiment of the present invention is shown in FIGS. 1-12. The wood reduction apparatus 10 is generally conventional (except as described herein) and therefore not described in detail. However, to facilitate an understanding of the present invention in the context of the illustrated embodiment, a brief overview is provided of the wood reduction apparatus and its operation. The illustrated wood reduction apparatus 10 generally includes a superstructure 12, an infeed assembly 14, a yoke assembly 16, a hammermill 18, an engine assembly 20 and an output conveyor 22. The infeed assembly 14 is mounted on the superstructure 12 and provides a mechanism for feeding wood waste into the hammermill 18. The infeed assembly 14 is described in more detail below, but for purposes of gaining a general understanding of the wood reduction apparatus, generally includes a bed 24 that is fitted with feed chains 54*a-d* (See FIGS. 11 and 12). The feed chains 54*a-d* are supported by the bed 24 and are power driven in a manner that moves the wood waste placed onto the bed 24 into the hammermill 18. The feed chains 54*a-d* may be driven by a motor (not shown). The motor may be variable speed to allow control over the speed at which wood waste is fed into the hammermill 18. The yoke assembly 16 includes a feed drum 28 that assists in shepherding wood waste into the hammermill 18. The yoke assembly 16 is pivotally mounted to superstructure 12 so that it can pivot up and down to accommodate wood waste of varying heights. For example, the yoke assembly 16 pivots up and down to permit the feed drum 28 to ride up and down over wood waste as it is moved under the feed drum 28 into the hammermill 18. The yoke assembly 16 may include a hydraulic cylinder (or other suitable mechanism) for applying an appropriate downward force on the feed drum 28. The feed drum 28 may be driven by a motor (not shown). The motor may be variable speed to allow control over the speed at which wood waste is fed into the hammermill 18. If power driven, the speed of the feed drum 28 may be synchronized with the speed of the feed chains 54*a-d*.

Figure 3:
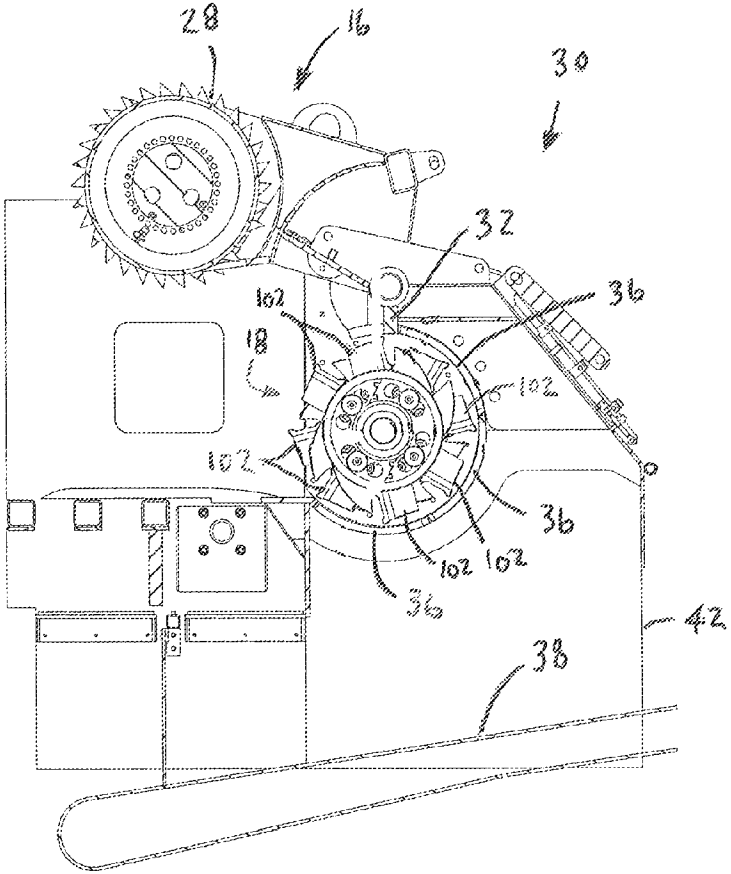
FIG. 3 is a sectional view of the base assembly showing the hammermill within the base assembly.
Figure 2:
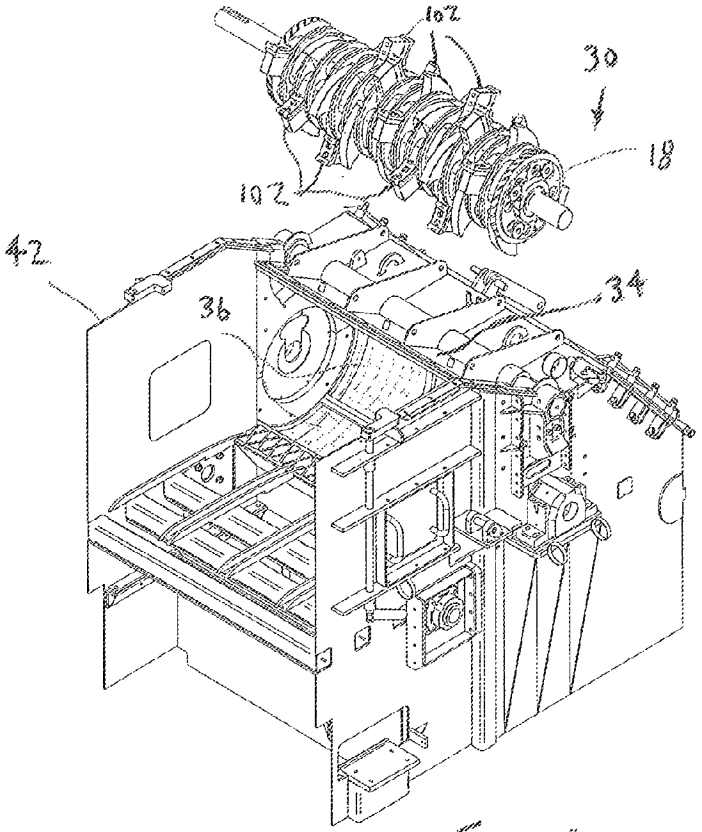
FIG. 2 is a partially exploded perspective view of the base assembly showing the hammermill removed from the base assembly.
Figure 4:
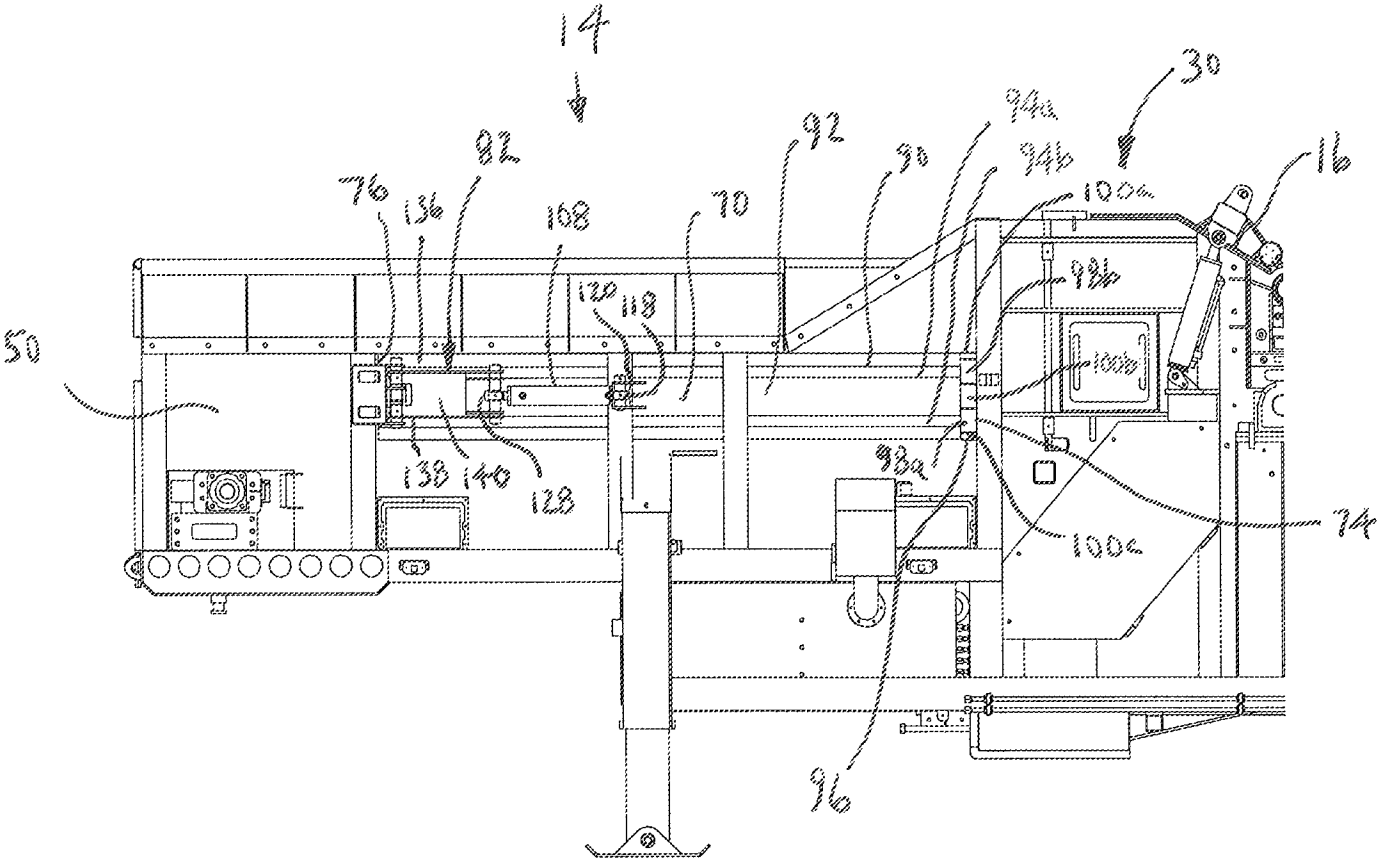
FIG. 4 is a right side elevational view of the feed assembly.

Referring now to FIGS. 2 and 3, the hammermill 18 is mounted within a base assembly 30. In the illustrated embodiment, the base assembly 30 generally includes a substructure 42 supporting an anvil 32, a hood 34 and a plurality of grates 36. The hammermill 18 is rotatably mounted to the substructure 42. The hammermill 18 is configured for upward rotation with respect the infeed side (i.e. the side on which wood waste is fed into the hammermill 18). Referring now to FIG. 3, the anvil 32 is mounted to the substructure 42 just above the hammermill 18. The spacing between the anvil 32 and hammermill 18 may vary, but is typically around $\frac{1}{4}^{th}$ of an inch. The grates 36 are mounted to the substructure 42 around the hammermill 18 (See FIG. 2, which shows the hammermill 18 removed from the base assembly 30). As perhaps best shown in FIG. 3, the grates 36 are curved to closely match the outer diameter of the hammermill 18. The spacing between the hammermill 18 and the grates 36 may correspond with the anvil spacing, but that is not strictly necessary. In operation, the hammermill 18 drives the wood waste upwardly hammering it into the anvil 32 and the grates 36. The wood waste is first reduced through interaction between the hammers 102 on the hammermill 18 and the anvil 32. The wood fragments are driven past the anvil 32 into the space between the hammermill 18 and the grates 36. The continued hammering action of the hammermill 18 further reduces the wood waste until it is driven through the openings in the grates 36. The reduced wood falls onto an intermediate conveyor 38 (typically a belly conveyor) extending below the hammermill 18 (See FIG. 3). The intermediate conveyor 38 transports the output to an inclined conveyor 22 (See FIG. 1) that lifts the output to facilitate piling. Given that the ground wood is forced into the space between the hammermill 18 and the anvil and through the grates 36, the size of the ground output is dictated in part by the anvil spacing and the size of the openings in the grates 36. The engine assembly 20, directly or indirectly, provides power to the various driven components of the wood reduction apparatus 10. For example, the engine assembly 20 drives the hammermill 18 through an arrangement of belts (not shown). As another example, the engine assembly 20 may drive one or more hydraulic pumps (not shown) that can be used to operate hydraulic components.

III. Infeed Assembly

As noted above, the wood grinder 10 includes an infeed assembly 14 having a bed 24 fitted with feed chains 54*a-d* that are power driven t move wood waste into the hammermill 18. The bed 24 of the illustrated embodiment generally includes a substantially horizontal surface configured to support the feed chains 54*a-d*. The bed 24 may be covered with wear components 60 that form the interface between the feed chains 54*a-d* and the bed 24. The wear components 60 may be sheets of metal or may be manufactured from low friction wear materials. The bed 24 maybe divided by dividers 62*a-c* into separate tracks 64*a-d*—one between each pair of adjacent feed chain 54*a-d*. In the illustrated embodiment, the infeed assembly 14 includes four feed chains 54*a-d* arranged side-by-side along the bed 24. In this embodiment, each feed chain 54*a-d* is slidably positioned into a corresponding track 64*a-d* in the bed 24. The dividers 62*a-d* help to hold the chains 54*a-d* in their respective tracks 64*a-b* and to reduce the possibility of unwanted interaction between adjacent chains 54*a-d*. The feed assembly 14 includes a feed chain drive assembly 66. The feed chain drive assembly 66 generally includes a drive shaft (not shown) carrying a plurality of drive sprockets (not shown), an idler shaft 56 carrying a plurality of the idler wheels 58 and a drive motor (not shown) coupled to the drive shaft. The drive shaft (not shown) and idler shaft 56 are disposed at opposite longitudinal ends of the bed 24. The feed chains 54*a-d* extend around the drive sprockets at one end and around idler wheels at the other. The drive shaft is coupled to a drive motor (not shown) so that movement of the chains 54*a-d* is achieved through movement of the drive motor. The drive motor (not shown) may be coupled to the drive shaft (not shown) using a gear assembly (not shown) that provides the desired combination of torque and speed. The drive motor (not shown) may be essentially any motor capable of providing sufficient torque to move the feed chains 54*a-d* and the material carried by the chains 54*a-d*, such as a hydraulic motor or an electric motor. If desired, the drive motor (not shown) may be operated by a control system that allows manual and/or automatic control over the speed and direction of the feed chains 54*a-d*. Although the illustrated embodiment includes feed chains, the infeed assembly 14 may alternatively include one or more feed belts or other mechanisms capable of moving wood waster over the bed 24 into the hammermill 18.

Referring now to FIGS. 4-5 and 11-12, the superstructure 12 includes sidewalls 50, 52 that extend upwardly along both sides of the bed 24 to retain wood waste on the bed 24. In the illustrated embodiment, the sidewalls 50, 52 are generally planar and extend substantially vertically along the entire length of the bed 24. The height of the sidewalls 50, 52 may vary from application to application, but is typically selected to provide sufficient height to retain wood waste on the bed 24. The construction of the sidewalls 50, 52 may vary from application to application. However, in the illustrated embodiment, the sidewalls 50, 52 include a plurality of generally flat panels, such as sheet metal, mounted to a vertical framework, such as a grid-work of steel tubes.

As shown in FIGS. 7-10 and 12, each sidewall 50, 52 includes a movable wall segment 70, 72 that is movable to vary the angle at which wood waste is fed into the hammermill 18. The wall segments 70, 72 of the illustrated embodiment extend longitudinally through a substantial portion of the length of the bed 24. The length of the wall segments 70, 72 may, however, vary from application to application as desired. In the illustrated embodiment, the wall segments 70, 72 are essentially identical except that they are oriented in opposite directions (See FIG. 9). Accordingly, only a single wall segment 70 will be described in detail. Wall segment 70 generally includes a frame 90 and a panel 92. The frame 90 includes a pair of horizontal supports 94*a-b* that extend essentially the full length of the wall segment 70. The size, shape, number and configuration of the horizontal supports 94*a-b* may vary from application to application to provide the desired strength and support for the wall segment 70. As perhaps best seen through comparison of FIGS. 1 and 7, wall segment 70 has a fixed end 74 that is pivotally mounted to the sidewall 50 and a free end 76 that is coupled to an actuator 82. Although the pivot structure may vary, in this embodiment, the fixed end of the wall segment 70 is mounted to the superstructure 12 by a barrel hinge 96. The wall segment 70 may include a pair of sleeves 98*a-b* fixed to the ends of horizontal supports 94*a-b*, for example, by welding. The superstructure 12 may include three sleeves 100*a-c* configured to interfit with the wall segment sleeves 98*a-b*. For example, the three sleeves 100*a-c* may be welded or otherwise secured to a vertical support in the vertical framework of the sidewall 50 with spacing appropriate to closely receive the wall segment sleeves 98*a-b*. A hinge pin 102 (See FIG. 9) may be fitted within the sleeves 98*a-b* and 100*a-c* to pivotally interconnect the wall segment 70 with the superstructure 12. The hinge pin 102 may be secured in place, for example, by a cotter pin, snap ring or similar component. In the illustrated embodiment, the free end of the wall segment 70 is pivotally secured to the actuator 82 so that the free end of the wall segment 70 may be moved by operation of the actuator 82. In this embodiment, the wall segment 70 includes a clevis assembly 114. As described in more detail below, the actuator 82 of the illustrated embodiment includes a linkage 110 that is coupled to the clevis assembly 114 to allow the actuator 82 to pivot the wall segment 70 into the space over the bed 24.

Figure 12:
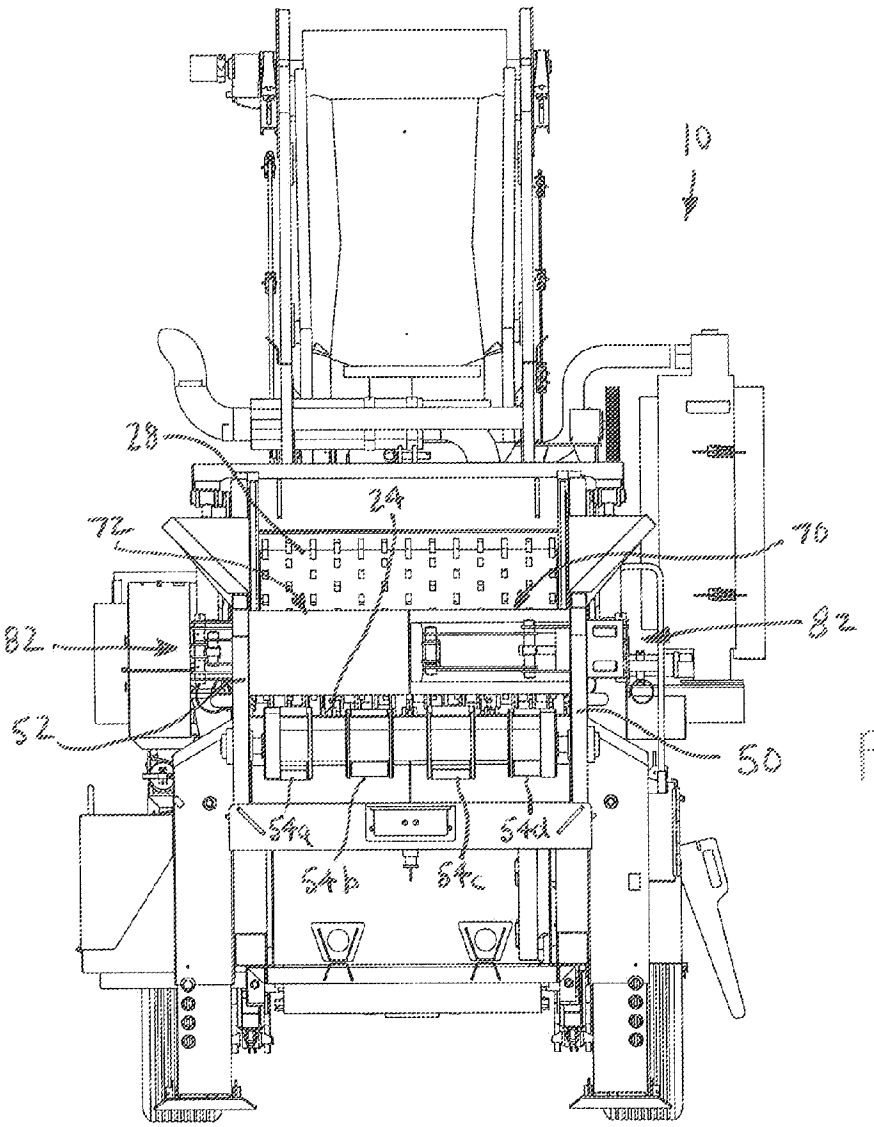
FIG. 12 is an end view of the wood reduction apparatus with the wall segments extended.

As perhaps best shown in FIG. 12, the bottom edge of the wall segment 70 is higher than the top surface of the feed chains 54*a-d* so that the wall segment 70 can be pivoted out into the space above the feed chains 54*a-d* without interference from the feed chains 54*a-d*. The spacing between the bottom edge of the wall segment 70 and the top of the feed chains 54*a-d* may vary from application to application depending in part on the range of vertical motion (e.g. bouncing) in the feed chains 54*a-d* during operation. If desired, a flap or skirt (not shown) may extend from the bottom edge of the wall segment 70 to the top surface of the feed chains 54*a-d* to close the gap. The flap or skirt (not shown) may be a flexible material, such as a strip of durable rubber or plastic.

Figure 5:
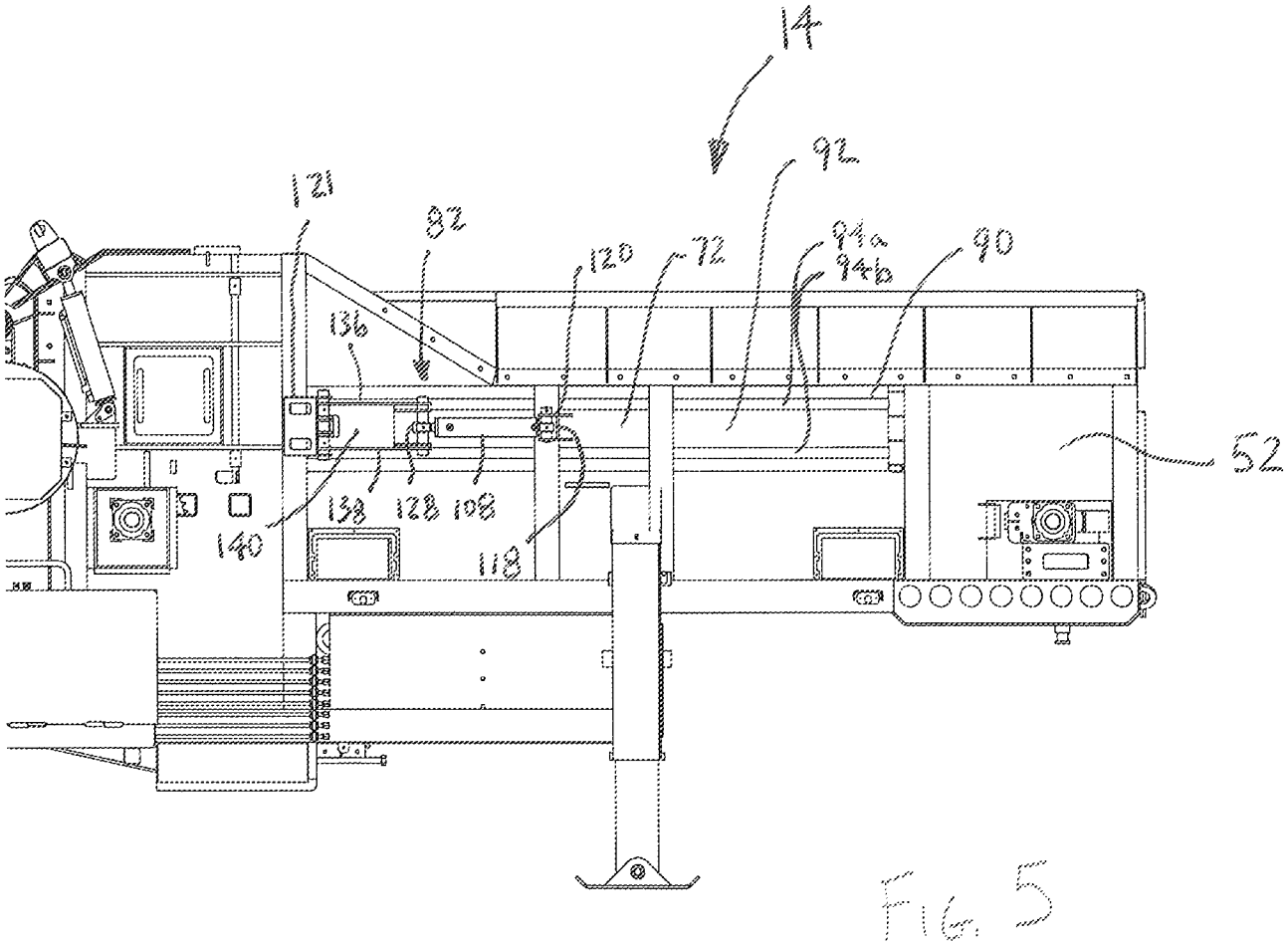
FIG. 5 is a left side elevational view of the feed assembly.
Figure 6B:
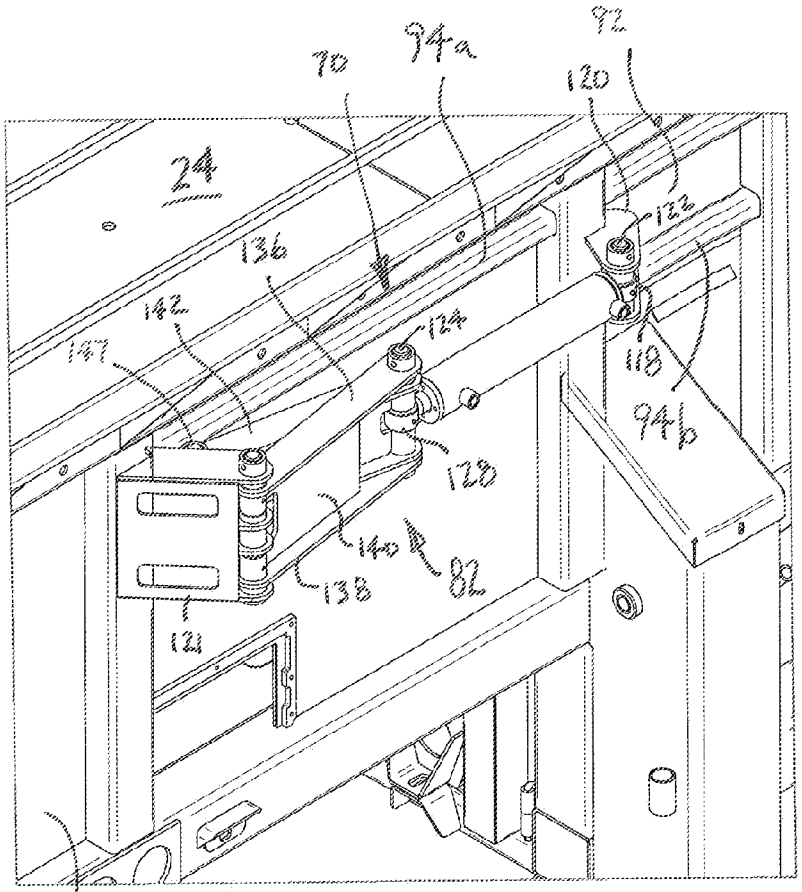
FIG. 6B is an enlarged view of Section 6B of FIG. 6A.
Figure 6A:
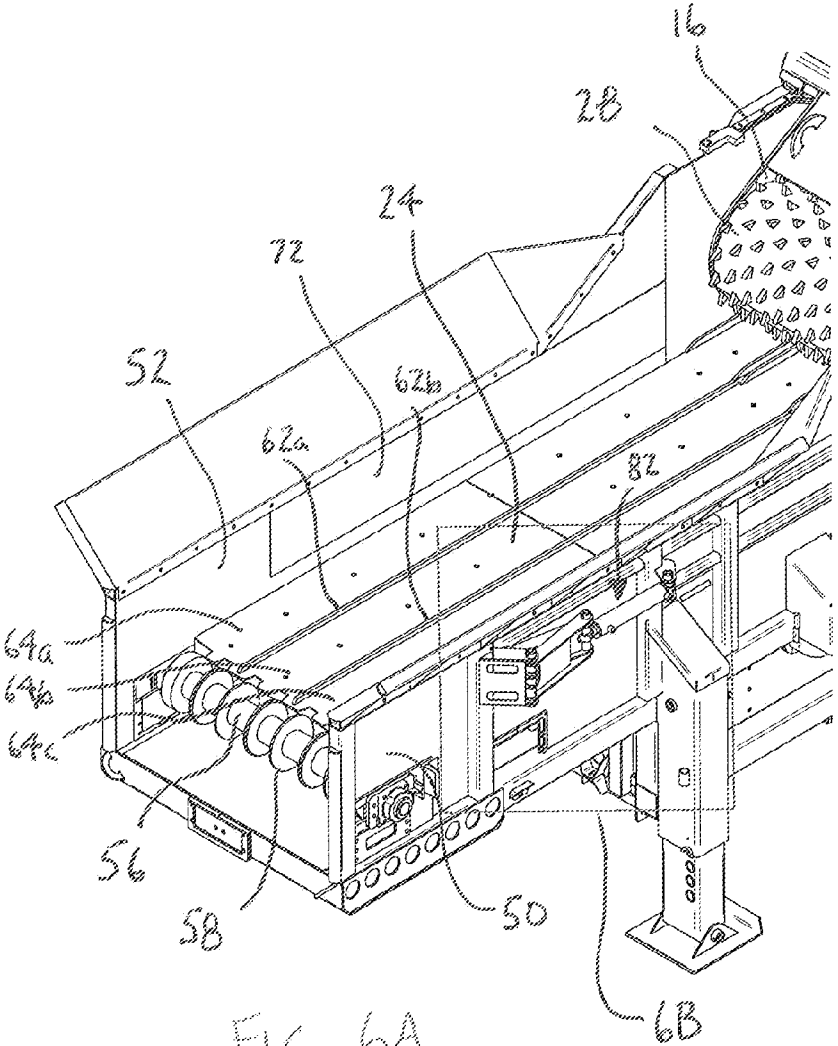
FIG. 6A is a perspective view of a portion of the feed assembly of FIG. 1.
Figure 7:
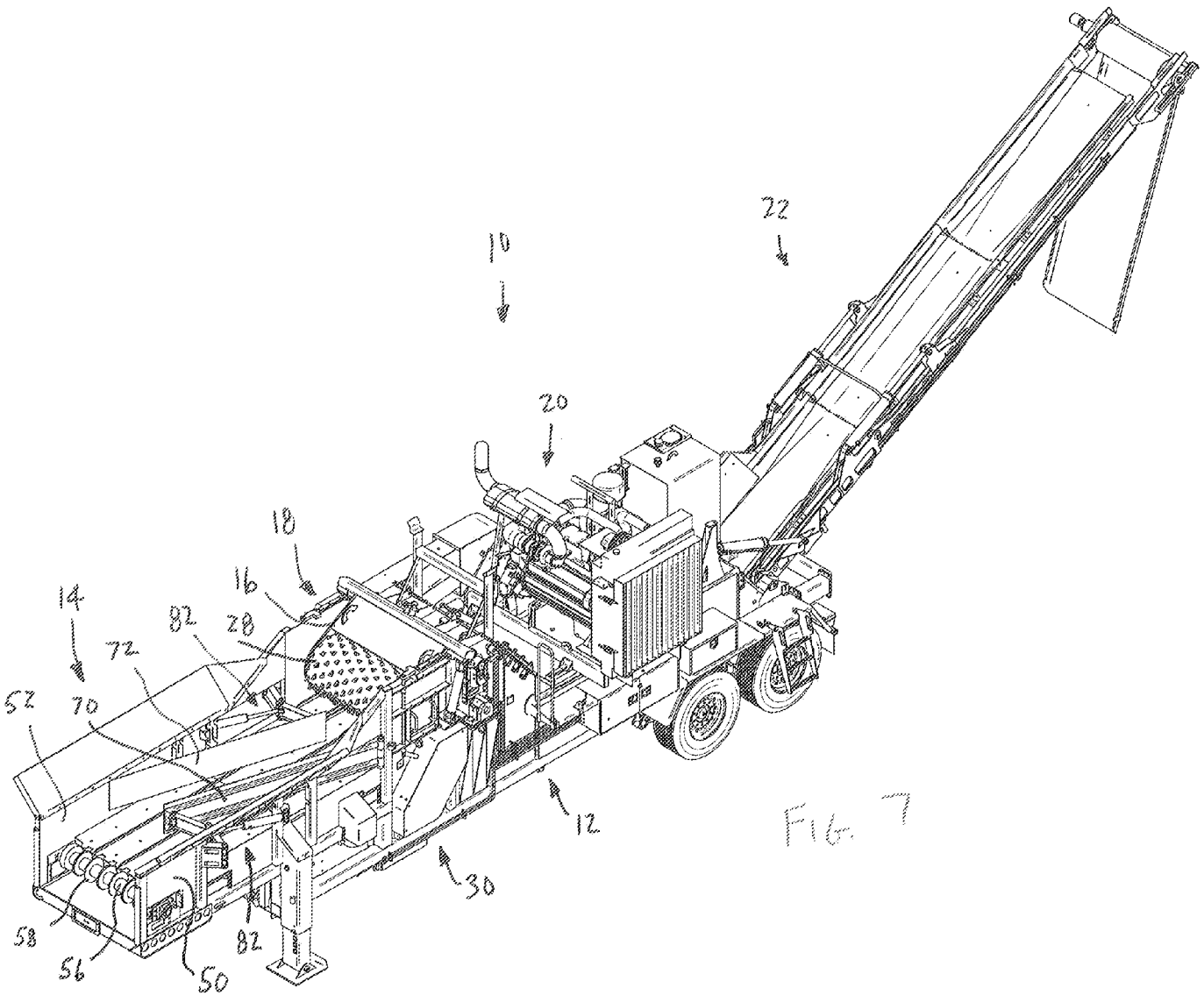
FIG. 7 is a perspective view of a wood reduction apparatus with the wall segments in the extended position.
Figure 8B:
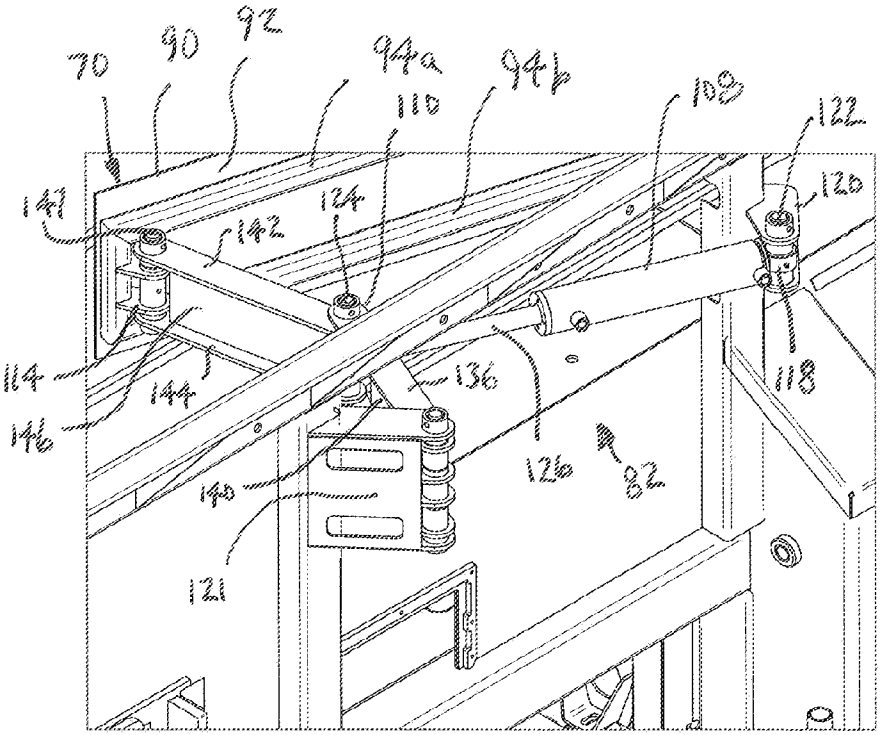
FIG. 8B is an enlarged view of Section 8B of FIG. 8A.
Figure 8A:
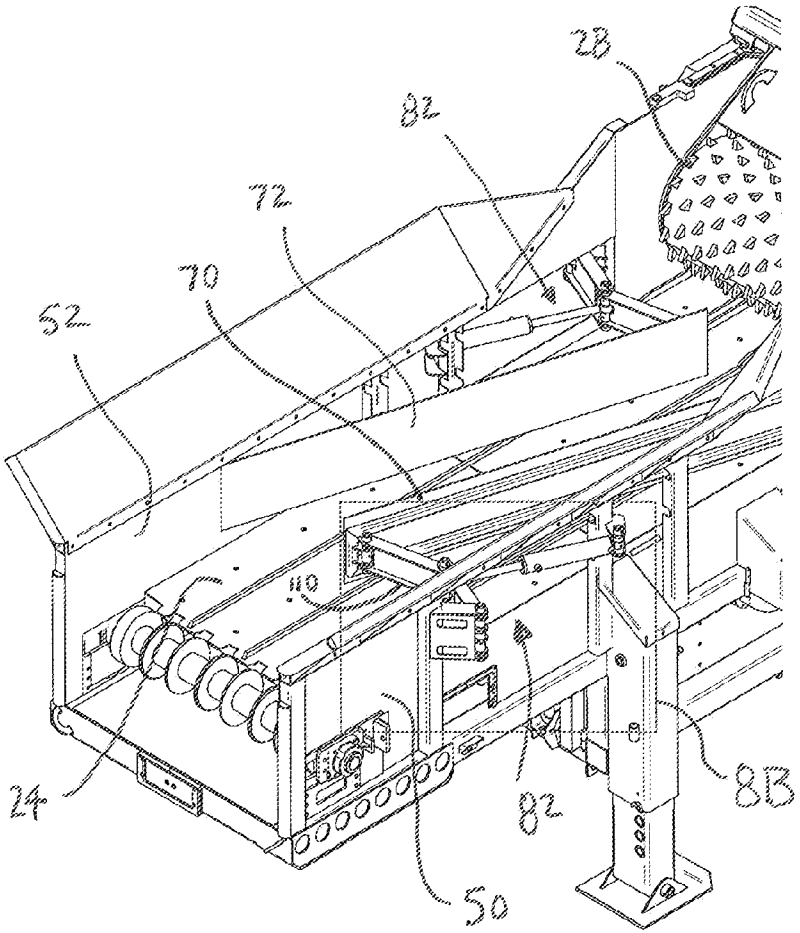
FIG. 8A is a perspective view of a portion of the feed assembly of FIG. 7.
Figure 10:
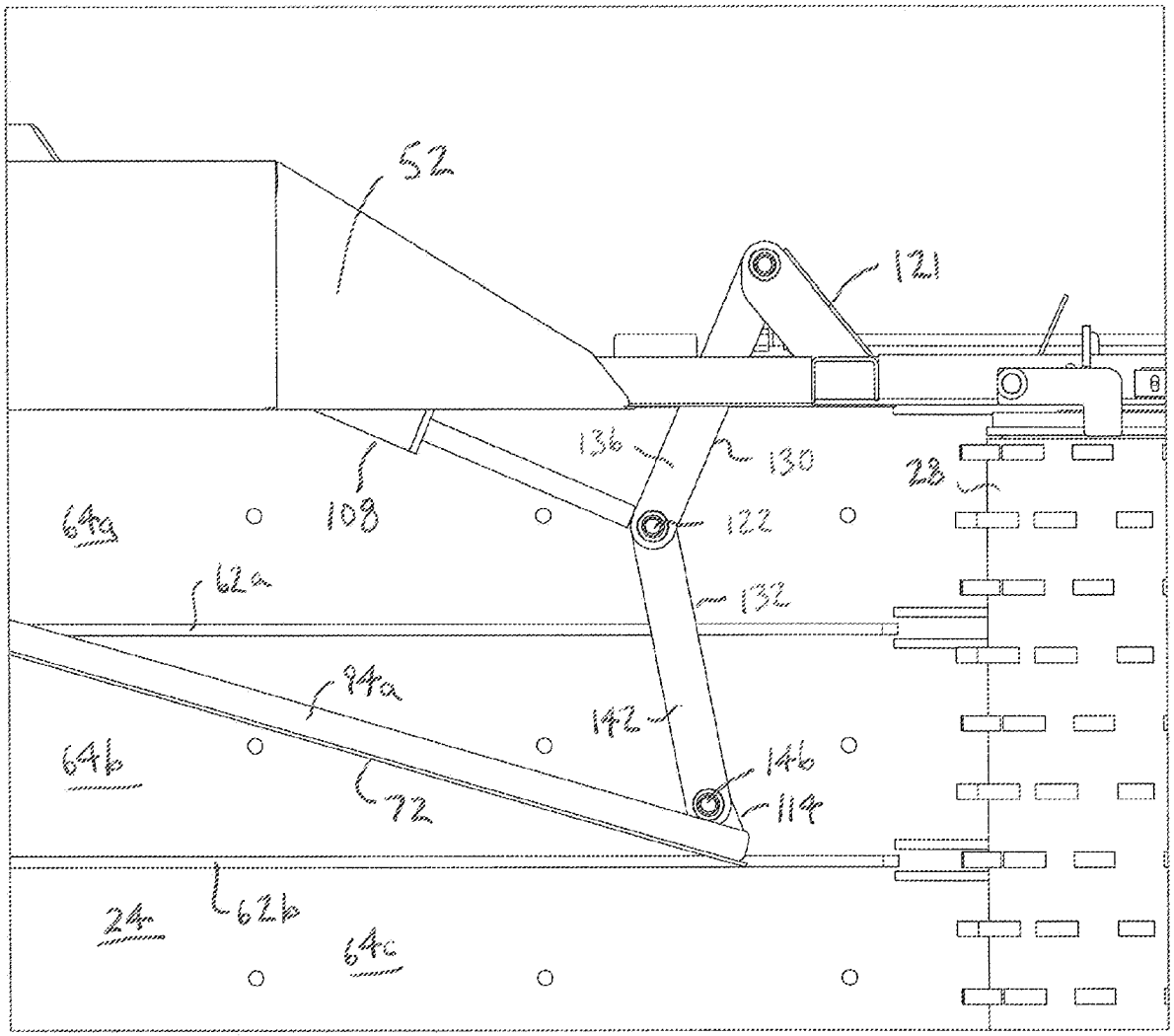
FIG. 10 is an enlarged top view of a portion of the feed assembly.
Figure 11:
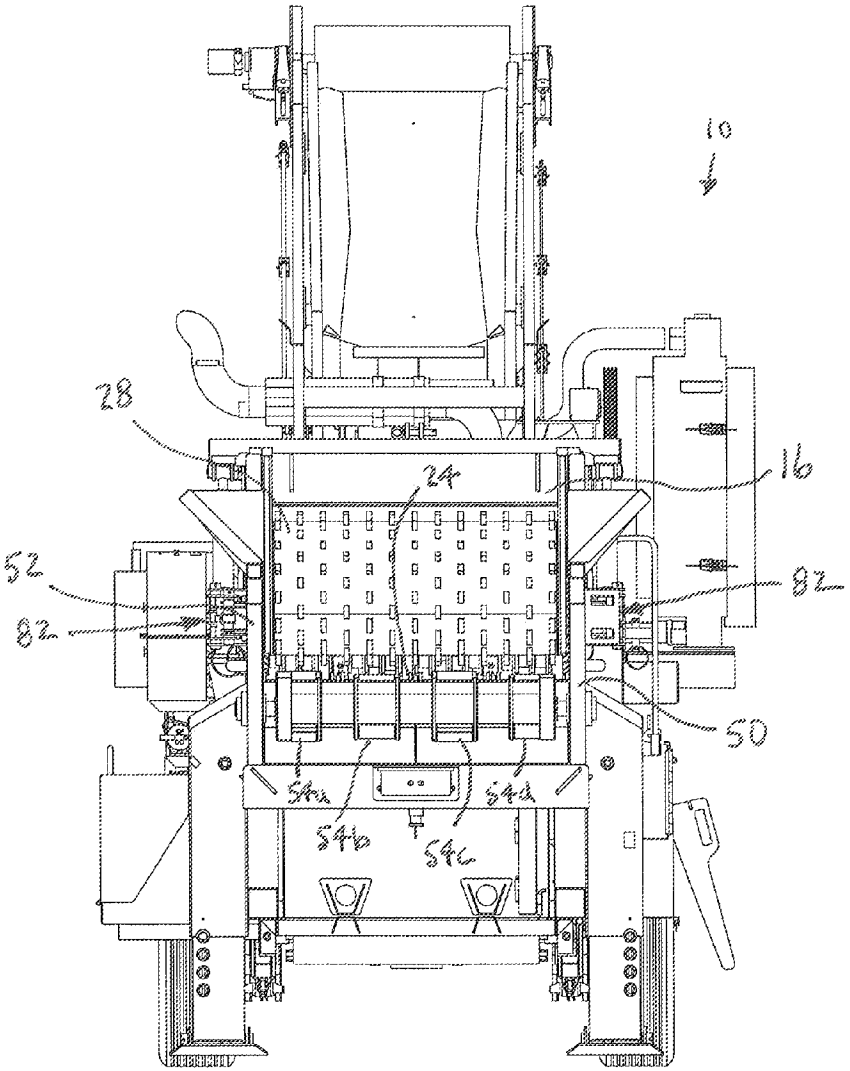
FIG. 11 is an end view of the wood reduction apparatus with the wall segments retracted.

As noted above, the infeed assembly 14 includes a pair of actuators 82 for moving the wall segments 70, 72 between the retracted and extended positions (See FIGS. 6A, 6B, 7A and 7B). In the illustrated embodiment, each sidewall 50, 52 includes a separate actuator 82, but a single actuator operatively coupled to both sidewalls 50, 52 may be used in some applications. In the illustrated embodiment, the actuators 82 are essentially identical except that they are oriented in opposite directions. Accordingly, only a single actuator 82 will be described in detail. Although only the actuator 82 operating wall segment 70 will be described in detail, FIGS. 5 and 10 show the actuator 82 of wall segment 72. The reference numerals used in connection with the detailed description of wall segment 70 and its actuator 82 are used to identify like (but generally minor image) components in FIGS. 5 and 10.

The actuator 82 of the illustrated embodiment generally includes a linear actuator 108 and a linkage 110. The linkage 110 is connected between a fixed point on the superstructure 12 and the free end 76 of the wall segment 70 so that operation of the linkage 110 results in movement of the free end 76 with respect to the superstructure 12. In the illustrated embodiment, the linear actuator 108 is a generally conventional double-acting hydraulic cylinder, but it could be essentially any other actuator (liner or non-linear) capable of operating the linkage 110 to move the wall segment 70 between extended and retracted positions. The illustrated linkage 110 is a hinge linkage, but it could be essentially any linkage that is capable of translating movement of the linear actuator 108 into movement of the wall segment 70. The hinge linkage 110 generally includes an inner arm 130 and an outer arm 132 that are pivotally joined along a hinge 134. The inner arm 130 includes upper and lower hinge bars 136, 138 that are coupled by a plate 140. The inner arm 130 terminates in a pin eye 117. The inner arm pin eye 117 is coupled to the clevis assembly 121 on the sidewall 50 by a pin 147. The pin 147 allows the inner arm 130 to pivot with respect to the sidewall clevis assembly 121 during operation of the actuator 82. Similarly, the outer arm 132 includes upper and lower hinge bars 142 and 144 that are coupled by a plate 146. Like the inner arm 130, the outer arm 132 terminates in a pin eye 116. The pin eye 116 is coupled to the clevis assembly 114 on the wall segment 70 by a pin 146. The pin 146 allows the outer arm 132 to pivot with respect to the wall segment 70 during operation of the actuator 82.

The hydraulic cylinder 108 is pivotally connected between a fixed point on the superstructure 12 and the hinge 134 of the linkage 110. More specifically, one end of the hydraulic cylinder 108 is connected to a clevis 120 or other mounting structure affixed to the superstructure 12. The clevis 120 may be a flange-mounted clevis that is welded or otherwise secured to a vertical support in the sidewall vertical framework. The hydraulic cylinder 108 of the illustrated embodiment includes a pin eye 118 that is secured to the clevis 120 by a clevis pin 122. The opposite end of the hydraulic cylinder 108 in the illustrated embodiment is directly secured to the hinge pin 124 of the linkage 110. As shown, the rod 126 of the hydraulic cylinder 108 terminates in a rod eye 128. The hinge pin 124 is fitted through the rod eye 128 to intersecure the hydraulic cylinder 108 and the linkage 110.

Although the infeed assembly 14 of the illustrated embodiment includes a pair of movable wall segments 70, 72, the infeed assembly may include only a single movable wall segment. For example, in some applications, movable wall segment 70 may be eliminated leaving only a single movable wall segment (e.g. wall segment 72) angling inwardly toward the hammermill 18.

The actuators 82, and consequently the position of the wall segments 70, 72, may be controlled by an automated control system (not shown). For example, a control button or other operator input device (e.g. key board, touch screen or mouse) may be used to direct a control computer to extend or retract the wall segments 70, 72. A single input may be used to dictate the position of both wall segments 70, 72. In this embodiment, the control computer extends/retracts both wall segments 70, 72 in response to a single operator input. Alternatively, control over the wall segments 70, 72 may be segregated so that a separate operator input is required for each wall segment 70, 72. As an alternative to the automated system, the wall segments 70, 72 may be operated through manual operation of appropriate controls. For example, each hydraulic cylinder may be extended and retractor through manual operation of a corresponding conventional hydraulic control valve. In this alternative, an operator may manually operate a 4-way hydraulic valve coupled to the hydraulic cylinders 108 to extend or retract the wall segments 70, 72. A single hydraulic valve may be used to control both hydraulic cylinders, or separate valves may be used to separately control the cylinders. In yet another alternative embodiment, the wall segments 70, 72 may be manually extended and retracted. In this embodiment, the hydraulic cylinders may be eliminated and the wall segments 70, 72 may be manually moved into the correct position and locked in place, for example, by locking the linkage in the desired position.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

The embodiments of the invention in which an exclusive property or privilege is claimed are defined as follows:

1. An infeed assembly for feeding material into a wood reduction apparatus comprising:

an adjustable infeed assembly for feeding material into the wood reduction apparatus, the infeed assembly being selectively adjustable in a lateral direction between a first configuration in which said infeed assembly feeds material into the wood reduction apparatus in a first direction substantially parallel to a longitudinal extent of the wood reduction apparatus and a second configuration in which said infeed assembly feeds material into the wood reduction apparatus in a second direction that is not substantially parallel to the longitudinal extent of the wood reduction apparatus, wherein the second direction is angled relative to the first direction about a substantially vertical axis.

2. An infeed assembly for feeding material into a wood reduction apparatus comprising:

an adjustable infeed assembly for feeding material into the wood reduction apparatus, the infeed assembly being selectively adjustable between a first configuration in which said infeed assembly feeds material into the wood reduction apparatus in a substantially perpendicular direction and a second configuration in which said infeed assembly feeds material into the wood reduction apparatus at an angle that is not substantially perpendicular;

the infeed assembly includes a mill; and said adjustable infeed assembly includes:

an infeed conveyor disposed adjacent the mill, said infeed conveyor arranged to feed material placed onto said conveyor into the mill;

a pair of sidewalls associated with said infeed conveyor, at least one of said sidewalls including a movable wall segment disposed adjacent to said infeed conveyor to shepherd the material into the mill, said movable wall segment being selectively movable between a first position in which the material is fed into the mill in a direction substantially perpendicularly to the mill and a said second position in which the material is fed into the mill at an angle; and an actuator for moving said movable wall segment between said first position and said second position.

3. The infeed assembly of claim 2 wherein said movable wall segment includes a first end pivotally secured to one of said sidewalls and second end that is movable away from said one of said sidewalls.

4. The infeed assembly of claim 3 wherein said first end of said movable wall segment is further defined as an end of said movable wall segment remote from the mill and said second end of said movable wall segment is further defined as an end of said movable wall segment toward the mill.

5. The infeed assembly of claim 4 wherein said conveyor includes a bed and a plurality of feed chains movably mounted over said bed, said chains moving in a direction substantially perpendicularly to the mill, said wall segment extending in a direction substantially parallel to said direction when in said first position and a direction substantially angled from said direction when in said second position.

6. The infeed assembly of claim 5 wherein said movable wall segment is disposed above and selectively movable over said feed chains, said second end of said movable wall segment being disposed over said bed when said movable wall segment is in said second position.

7. The infeed assembly of claim 2 wherein both of said sidewalls include a movable wall segment disposed adjacent to said infeed conveyor to shepherd the material into said mill, both of said movable wall segment being selectively movable between a first position in which the material is fed into said mill in a direction substantially perpendicularly to said mill and a said second position in which the material is fed into said mill at an angle.

8. A wood reduction apparatus comprising:

a mill defining an axis of rotation;

an adjustable infeed assembly for feeding material into said mill, the infeed assembly being selectively adjustable laterally between a first configuration in which said infeed assembly feeds material into said mill at a first angle with respect to said mill axis of rotation and a second configuration in which said infeed assembly feeds material into said mill at a second angle with respect to said mill axis of rotation, wherein said first and second angles are substantially horizontally coplanar.

9. A wood reduction apparatus comprising:

a mill;

an adjustable infeed assembly for feeding material into said mill, the infeed assembly being selectively adjustable between a first configuration in which said infeed assembly feeds material into said mill at a first angle with respect to said mill and a second configuration in which said infeed assembly feeds material into said mill at a second angle with respect to said mill;

wherein said adjustable infeed assembly includes an infeed conveyor disposed adjacent to said mill, said infeed conveyor arranged to feed material placed onto said conveyor into said mill; and a first sidewall disposed adjacent to said infeed conveyor to shepherd the material into said mill, said sidewall including at least a segment that is selectively movable between a first position in which the material is fed into said mill in a direction substantially perpendicularly to said mill and a said second position in which the material is fed into said mill at an angle.

10. The wood reduction apparatus of claim 9 wherein said wood reduction apparatus has a longitudinal extent, said mill including a hammermill, said hammermill rotating about an axis substantially perpendicularly to said longitudinal extent.

11. The wood reduction apparatus of claim 9 wherein said segment includes a first end pivotally secured to said sidewall and second end that is movable away from said sidewall.

12. The wood reduction apparatus of claim 11 further including an actuator for moving said second end of said segment to selectively move said segment between said first position and said second position.

13. The wood reduction apparatus of claim 9 further including a second sidewall disposed adjacent to said infeed conveyor opposite said first sidewall to shepherd the material into said mill, said second sidewall including at least a segment that is selectively movable between a first position in which the material is fed into said mill in a direction substantially perpendicularly to said mill and a said second position in which the material is fed into said mill at an angle.

14. The wood reduction apparatus of claim 13 wherein said segment of said second sidewall includes a second end pivotally secured to said second sidewall and a first end that is movable away from said second sidewall; and further including an actuator for moving said first end of said segment of said second sidewall to selectively move said segment of said second sidewall between said first position and said second position.

15. The wood reduction apparatus of claim 14 wherein said infeed conveyor includes a plurality of feed chains, said chains movable in a direction substantially perpendicularly to said mill, said segment of said first sidewall and said segment of said second sidewall both extending in a direction substantially parallel to said direction of movement of said chains when in said first position and a direction substantially angled from said direction when in said second position.

16. The wood reduction apparatus of claim 15 wherein said segment of said first sidewall and said segment of said second sidewall are disposed substantially opposite one another in a lateral direction across said infeed conveyor.

17. The wood reduction apparatus of claim 16 further including a control computer for operating both said actuator of said segment of said first sidewall and said actuator of said segment of said second sidewall in response to a single operator input.

* * * * *